United States Patent [19]

Grosswendt et al.

[11] Patent Number: 4,889,053

[45] Date of Patent: Dec. 26, 1989

[54] PROJECTILE EQUIPPED WITH BRAKING PARACHUTE

[75] Inventors: Werner Grosswendt, Ratingen; Klaus Unterstein, Düsseldorf; Walter Simon, Herzogenrath, all of Fed. Rep. of Germany

[73] Assignee: Rheinmetall GmbH, Düsseldorf, Fed. Rep. of Germany

[21] Appl. No.: 272,777

[22] PCT Filed: Jan. 14, 1988

[86] PCT No.: PCT/EP88/00022

§ 371 Date: Oct. 17, 1988

§ 102(e) Date: Oct. 17, 1988

[87] PCT Pub. No.: WO88/06267

PCT Pub. Date: Aug. 25, 1988

[30] Foreign Application Priority Data

Feb. 18, 1987 [DE] Fed. Rep. of Germany ..... 3705078

[51] Int. Cl.[4] ..... F42B 4/12; F42B 15/02

[52] U.S. Cl. ..... 102/348; 102/340; 102/354; 102/377; 102/387

[58] Field of Search ..... 102/340, 337, 338, 339, 102/348, 354, 387, 377, 378

[56] References Cited

U.S. PATENT DOCUMENTS

| | | | |
|---|---|---|---|
| 3,038,407 | 6/1962 | Robertson et al. | 102/340 |
| 3,487,781 | 1/1970 | Oss | 102/377 |
| 3,730,099 | 5/1973 | Schopp | 102/340 |
| 3,791,300 | 2/1974 | Prochnow et al. | 102/340 |
| 3,834,312 | 9/1974 | Simmons | 102/339 |
| 4,226,185 | 10/1980 | Tobler et al. | 102/340 |

FOREIGN PATENT DOCUMENTS 1579025 8/1969 France .

*Primary Examiner*—David H. Brown

*Attorney, Agent, or Firm*—Spencer & Frank

[57] ABSTRACT

The invention relates to a projectile including a cylindrical receiving chamber (4) delimited by an interior wall (3) for a braking parachute (17) which can be ejected by way of a piston (9) that is longitudinally displaceable in the projectile, with the piston (9) being chargeable by an ignitable pyrotechnic charge (10). The braking parachute (17) is encased in a longitudinally divided sleeve (18) one side of which is in engagement with the piston (9). In order to completely or partially recover the projectile and not to impede deployment of the braking parachute (17), it is provided that the rear of the receiving chamber (4) is sealed by a cover (23) which can be ejected by way of the piston (9), is equipped with a rotational imbalance (26) and is in engagement with the other side of the sleeve (18). The braking parachute (17) is fastened to the piston (9). The projectile or a part (1) thereof connected with projectile components to be recovered is provided with a catch ring (21) disposed at the rear exit end of the receiving chamber (4) for the piston (9). The sleeve (18) is able to pass through the catch ring. Guides (19, 28) for the sleeve (18) are provided at the interior wall (3) of the receiving chamber (4).

8 Claims, 2 Drawing Sheets

PROJECTILE EQUIPPED WITH BRAKING PARACHUTE

BACKGROUND OF THE INVENTION

The invention relates to a projectile equipped with a braking parachute. More particularly, the present invention relates to a projectile including a receiving chamber delimited by an interior wall for a braking parachute which can be ejected by a piston that is longitudinally displaceable in the projectile, with the piston being chargeable by an ignitable pyrotechnic charge and with the braking parachute being surrounded by a longitudinally divided sleeve which at one end is in engagement with the piston.

Such a projectile is disclosed in DE-OS No. 2,824,203, in which a brake band or braking parachute is disposed within two half shells which are disposed flush with the interior walls of the receiving chamber for the brake member. The brake member is connected with a fuze of the projectile and can be ejected from the projectile by way of a piston engaging at the half shells. The ejection occurs from the tail end, with the component carrying the fuze being sheared from the projectile body and ejected forwardly. Aside from the fact that this prevents the entire projectile from being recovered, the likewise ejected piston and the remaining projectile body may interfere with deployment of the brake member since the former are disposed in the path of flight of the fuze.

SUMMARY OF THE INVENTION

It is an object of the invention to provide a projectile of the above-mentioned type which can be recovered completely or in part and in which deployment of the braking parachute is not interfered with by other components.

This object is accomplished according to the present invention by a projectile including a receiving chamber delimited by an interior wall for a braking parachute which can be ejected by a piston that is longitudinally displaceable in the projectile, with the piston being chargeable by an ignitable pyrotechnic charge and with the braking parachute being surrounded by a longitudinally divided sleeve which at one end is in engagement with the piston, and wherein: the rear of the receiving chamber is sealed by a cover which can be ejected by the piston and which is in engagement with the other end of the sleeve; the braking parachute is fastened to the piston; the projectile, or a part thereof connected with projectile components which are to be recovered, is provided, at the rear exit end of the receiving chamber, with a catch ring for the piston, with the catch ring allowing passage of the sleeve; and guides for the sleeve are provided at the interior wall of the receiving chamber.

The braking parachute is ejected toward the rear and the piston to which the braking parachute is fastened is caught in the projectile to be recovered or in a part which is connected with components to be recovered. A cover at the tail end is sheared off and its rotational imbalance causes it to leave the trajectory of the projectile due to the rotation of the projectile so that it cannot interfere with deployment of the braking parachute.

Further features of the invention will be found in the description below and in the dependent claims.

The invention will now be described in greater detail with reference to embodiments illustrated in the attached drawing figures. .

DETAILED DESCRIPTION OF THE PREFERRED EMBODIMENTS

Figure 1:
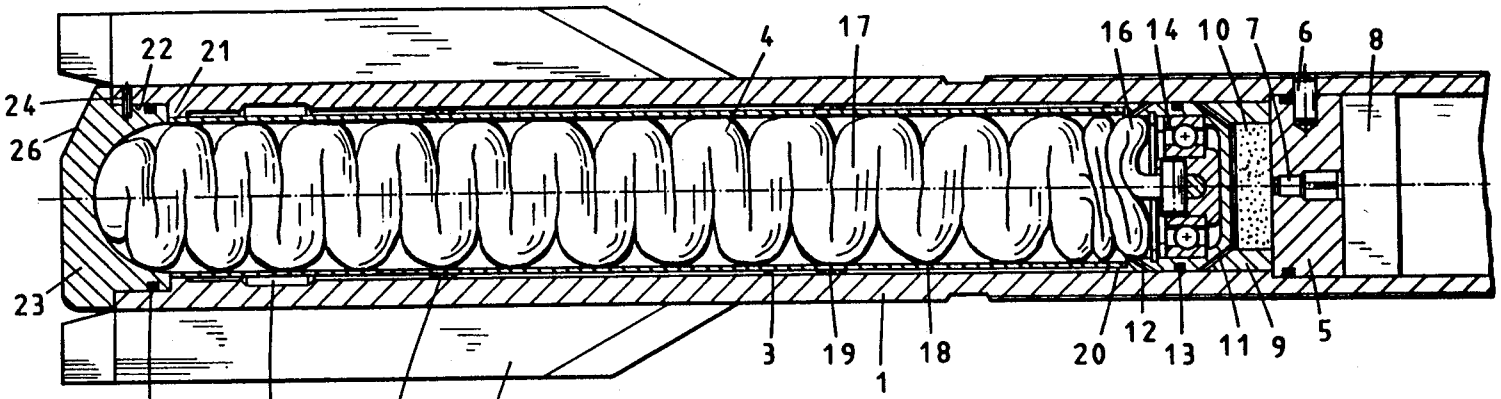
FIG. 1 is a longitudinal sectional view of a projectile equipped with a braking parachute.
Figure 2:
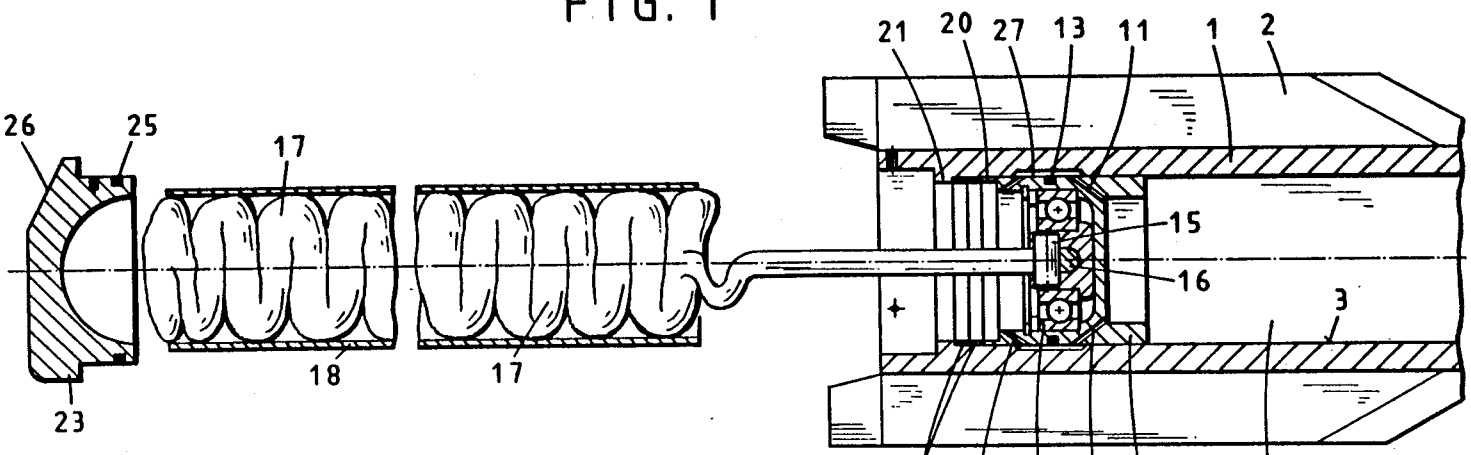
FIG. 2 is a sectional view of the projectile of FIG. 1 with ejected braking parachute.

The projectile shown in FIG. 1 includes a projectile body 1 provided with fins 2 at the rear and with a circularly cylindrical receiving chamber 4 which is defined by an interior wall 3 and is delimited at the front by an insert ring 5 connected by way of shear pins 6 with projectile body 1. Insert ring 5 is provided with a bore to accommodate a flame capsule 7 which can be ignited by way of an electrical fuze 8 disposed at the front of insert ring 5. At the rear, insert ring 5 is followed by a piston 9 whose front end accommodates a pyrotechnic charge 10 that can be ignited by way of flame capsule 7. The force generated by ignition of pyrotechnic charge 10 and the gas pressure generated thereby acts on the frontal face of piston 9 and displaces it in receiving chamber 4 in the direction toward the rear.

Piston 9 is equipped with a plurality of bores 11 which open, on the one hand, into the frontal recess for pyrotechnic charge 10 and, on the other hand, at the outer circumference of piston 9. Bores 12 also open at the outer circumference of piston 9; these bores also open at the rear face of piston 9. Between the openings of bores 11 on the outer circumference, on the one hand, and bores 12, on the other hand, piston 9 is provided with a circumferential piston seal 13 in the form of an O ring.

At its rear face, piston 9 is equipped with a ball bearing 14 whose inner race is connected with a pin 15 extending transversely to the axis of the projectile for fastening the loop 16 of a braking parachute 17.

Braking parachute 17 is disposed within a thin-walled, longitudinally divided sleeve 18, for example divided into three parts and made of plastic or metal. On its outer circumference, sleeve 18 is provided with two guide rings 19 which are connected with sleeve 18 but can be sheared off so that sleeve 18 is only one piece when installed. Guide rings 19 are in engagement with interior wall 3. Moreover, an annular lip 20 of piston 9 passes over the exterior of sleeve 18 and is in engagement with the rear face of piston 9.

At the rear, receiving chamber 4 is provided with a catch ring 21 whose inner diameter corresponds to the outer diameter of sleeve 18 and whose thickness corresponds to the thickness of annular lip 20 and guide rings 19. At the rear face, adjacent to catch ring 21, a recess 22 is provided which receives a cover 23 fastened to projectile body 1 by means of shear pins 24 and lies with its rear face at sleeve 18 or, more precisely, at catch ring 21, with sleeve 18 extending to the rear end of ring 21. Between cover 23 and projectile body 1, there is provided a seal 25 so that cover 23 gastightly seals receiving chamber 4 against the powder gases when the projectile is fired by means of a tubular weapon. Moreover, the rear of cover 23 is provided with a flattened portion 26 which serves as rotational imbalance.

Braking parachute 17 is activated by way of pyrotechnic charge 10. The force generated by the gas pressure developed thereby is transferred from piston 9 to the longitudinally divided sleeve 18 as well as to cover 23 which is thus sheared off. After shear pins 24 are sheared off, the gas pressure pushes cover 23, sleeve 18 and braking parachute 17 out of the tail section of the projectile. At the same time, piston 9 is moved rearward with the components. In order for sleeve 18 not to spread open in receiving chamber 4, its front end is held by the annular lip 20 of piston 9. Guide rings 19 also serve to prevent such spreading open and are glued, for example, onto sleeve 18. During ejection, the two guide rings 19 are sheared off from sleeve 18 when they reach catch ring 21 and are retained there. Piston 9 is also caught there but sleeve 18 leaves the projectile together with braking parachute 17. Outside of the projectile, cover 23 and sleeve 18 separate from one another and additionally sleeve 18 is separated from braking parachute 17 so that the latter is able to deploy.

The flattened portion 26 on cover 23 has the result that cover 23 is propelled out of the trajectory of the projectile since the projectile rotates at a certain rpm. In this way, a collision with braking parachute 17 is prevented.

To let the gas pressure escape from the projectile when piston 9 has reached its end position, a groove 27 is milled out of interior wall 3 of receiving chamber 4 and is given such a length that the openings of bores 11 and 12 of piston 9 are connected with one another by groove 27 so as to permit the gas to escape to the outside in that it flows around piston seal 13. This permits safe manipulation of the projectile after firing ceases.

Figure 3:
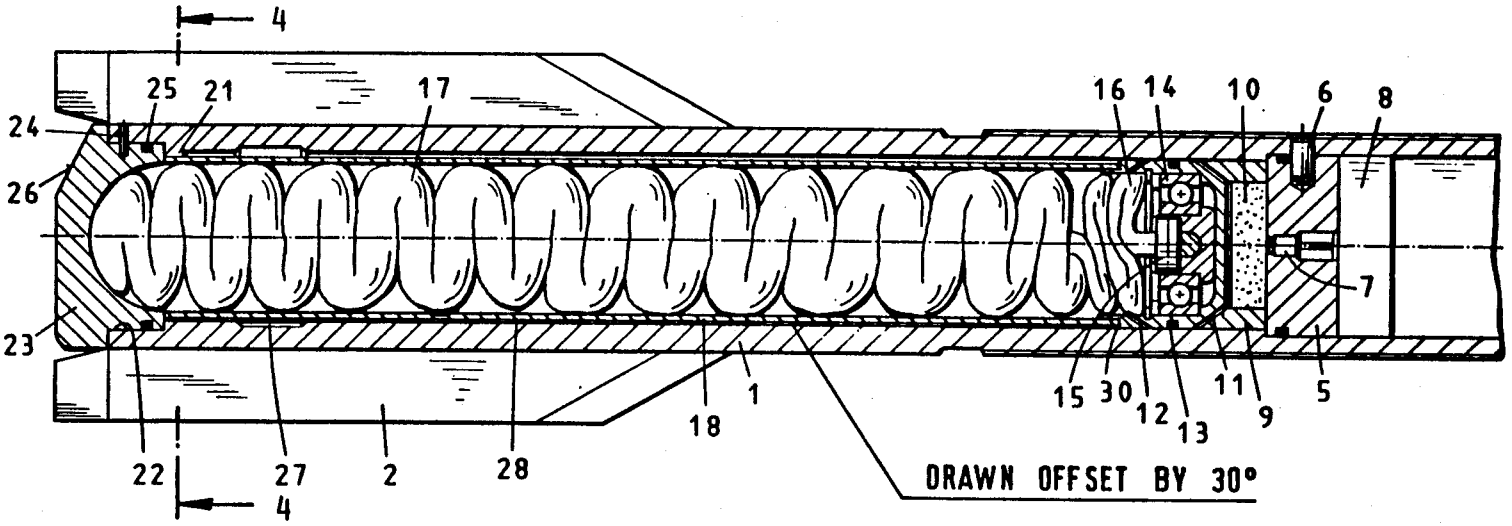
FIG. 3 is a longitudinal sectional view of a further embodiment of a projectile.
Figure 4:
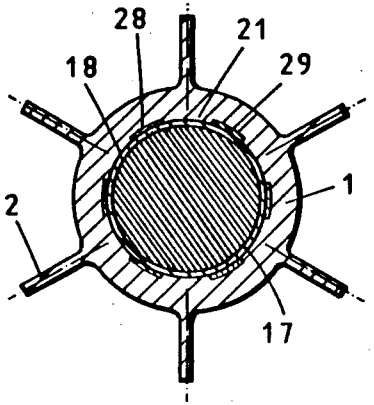
FIG. 4 is a sectional view along line IV—IV of FIG. 3.

In the embodiment shown in FIGS. 3 and 4, longitudinal ribs 28 are disposed on each segment of sleeve 18. These ribs may be shaped by gluing, soldering or welding or by appropriate shaping. Catch ring 21 is provided with corresponding, groove-shaped passage openings 29. Longitudinal ribs 28 extend over the entire length of the segments of sleeve 18. They prevent sleeve 18 from spreading open in the tail section of the projectile. The outer circumference of the sleeve-shaped, rear section of piston 9 is provided with a shoulder 30 and sleeve 18 which lies against shoulder 30 grips around this rear section.

We claim:

1. Projectile including a receiving chamber (4) delimited by an interior wall (3) for a braking parachute (17) which can be ejected by way of a piston (9) that is longitudinally displaceable in the projectile, with the piston (9) being chargeable by an ignitable pyrotechnic charge (10) and the braking parachute (17) being surrounded by a longitudinally divided sleeve (18) which at one end is in engagement with the piston (9), characterized in that the rear of the receiving chamber (4) is sealed by a cover (23) which can be ejected by way of the piston (9) and which is in engagement with the other end of the sleeve (18); the braking parachute (17) is fastened to the piston (9); the projectile or a part (1) thereof connected with projectile components which are to be recovered is provided, at the rear exit end of the receiving chamber (4), with a catch ring (21) for the piston (9), said catch ring allowing passage of the sleeve (18) and guides (19, 28) for the sleeve (18) are provided at the interior wall (3) of the receiving chamber (4).

2. Projectile according to claim 1, characterized in that the guides include rings (19) which are fastened to the outer circumference of the sleeve (18) so as to be sheared off by the catch ring (21).

3. Projectile according to claim 1, characterized in that the exterior of the sleeve (18) is provided with guide ribs (28) while the catch ring (21) is provided with passage openings (29) for the guide ribs (28).

4. Projectile according to claim 1, characterized in that the piston (9) passes around the exterior of the sleeve (18) by way of an annular lip (20).

5. Projectile according to one of claim 1, characterized in that the piston (9) is provided with at least two bores (11, 12) which open at its outer circumference, at least one of which opens on the frontal face of the piston (9) facing away from the braking parachute (17), while in the caught position of the piston (9) an annular channel (27) is provided in the interior wall (3) of the receiving chamber (4) so as to connect the bores (11,12) with one another.

6. Projectile according to one of claim 1, characterized in that the cover (23) is provided with a flattened portion (26).

7. Projectile according to one of claim 1, characterized in that, on its side facing the braking parachute, the piston (9) is provided with a rotatably mounted eye (15) to which the braking parachute (17) is fastened.

8. Projectile according to one claim 1, characterized in that the cover (23) is provided with a rotational imbalance.

* * * * *